United States Patent [19]

Gold

[11] 4,431,186

[45] Feb. 14, 1984

[54] BILLIARD GAME TABLE

[76] Inventor: John Q. Gold, 352 69th St., San Diego, Calif. 92114

[21] Appl. No.: 236,783

[22] Filed: Feb. 23, 1981

[51] Int. Cl.[3] ..... A63D 15/00

[52] U.S. Cl. ..... 273/3 A; 273/123 R

[58] Field of Search ..... 273/3 R, 3 A, 4 R, 4 A, 273/8, 9, 87 R, 87 B, 57, 108, 109, 115, 176 R, 176 A, 176 AA, 176 D, 176 B, 123 R; D21/232

[56] References Cited

U.S. PATENT DOCUMENTS

| | | | |
|---|---|---|---|
| 241,473 | 5/1881 | Boyd | 273/3 A |
| D. 247,454 | 3/1978 | Salazar | D21/232 |
| 835,177 | 11/1906 | Callahan | 273/3 A |
| 1,221,181 | 4/1917 | Hooper | 273/87 B X |
| 3,360,265 | 12/1967 | Yabroudy | 273/3 R X |
| 3,985,355 | 10/1976 | Shoemaker | 273/3 A |

FOREIGN PATENT DOCUMENTS

| | | | |
|---|---|---|---|
| 1203467 | 7/1959 | France | 273/3 R |
| 1274045 | 9/1961 | France | 273/115 |

*Primary Examiner*—Richard C. Pinkham
*Assistant Examiner*—T. Brown
*Attorney, Agent, or Firm*—Charmasson, Branscomb & Holz

[57] ABSTRACT

A game table is provided for a billiard-style game having a planform shape similar to an arrowhead with convering forward side rails and tapered rear rails shaped to cooperate with a pair of interior symmetrically disposed islands and a pair of pocket holes to provide a table of increased interest for playing a number of different billiard type games.

8 Claims, 3 Drawing Figures

BILLIARD GAME TABLE

BACKGROUND OF THE INVENTION

Dozens of different style billiard tables have been devised over the years incorporating all manner of angles, curves, different numbers of pockets and bumpers. Some of these games may be undesireable in that they provide frustrating game circumstances such as, for example, situations in which the player frequently encounters himself having no feasible shot. Other types of tables may pit each player against the other in such a way that because of the positioning of the pockets associated with each player, the ball simply goes back and forth as the players switch turns indefinitely many times before a lucky shot is made to sink it. This is undesireable inasmuch as, aside from possibly an eight ball shot in regulation pool, it is not a good idea in a billiard type game to have the players constantly hitting the same ball toward opposite pockets as it does not permit each player the opportunity to align and set up his own balls over a period of several shots.

Other billiard-type tables are simply modifications in shape of a standard, rectangular open billiard table, and fail to offer the added interest in play promised by the unusual shape. There is a need, therefore, for a well thought-out billiard table which provides not only a unique and continuously interesting shape, but also eliminates frustrating cul-de-sacs and situations which denigrate the quality and amusing capabilities of the game.

SUMMARY OF THE INVENTION

The present invention fulfulls the above-stated need by providing a game having a multiplicity of different angles and banks, including a pair of unique central islands, each defining an interior bay, with the angles and relationships between bumpers being so defined as to maximize the ability of a skilled player to sink balls in his designated pocket from virtually any position on the board while simultaneously, by virtue of the many barriers and angular relationships, forcing the novice to carefully analyze angles of incidence and reflection for all shots made in order to have a chance at sinking the ball.

The table is set up with a generally arrowhead-shaped platform defining a frontal generally pentagonal playing area and a rearward larger playing area shaped similar to a truncated diamond. These two playing areas being connected through a straight central channel as well as a pair of peripheral corridors, the rear ends of which lie adjacent the pocket drops.

An addition to the exterior bumpers, these channels, corridors, and playing areas are defined by a pair of hairpin-shaped islands, the outer bumpers of which define the above-mentioned corridors, and inner segments defining the straight channel. The lateral outcroppings of the table are shaped to enable a player with reasonable skill to sink a ball from anyplace on the upper peripheral areas of the table by virtue of the contiguous double, intermediate bumper structure adjoining the sloping front walls and the sloping rear walls. The relationships will be understood in more detail in the following detailed description of the preferred embodiment.

DETAILED DESCRIPTION OF THE PREFERRED EMBODIMENT

Figure 1:
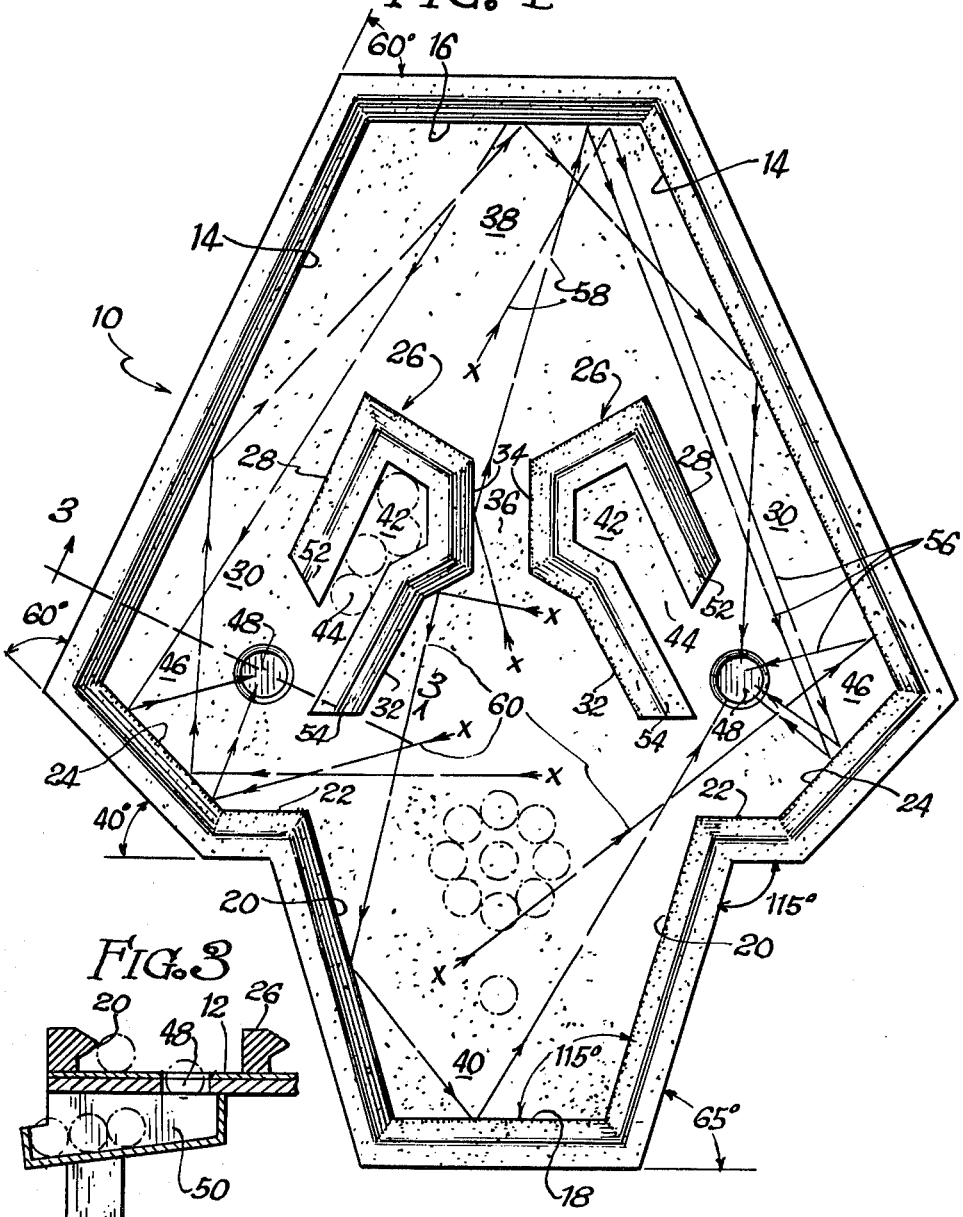
FIG. 1 is a top plan view of the table indicating angular relationships of the bumpers and typical bank shot paths.
Figure 3:
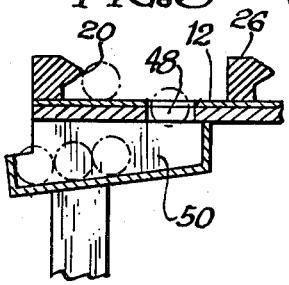
FIG. 3 is a section taken along line 3—3 of FIG. 1.

The table of the instant invention is indicated generally at 10 and comprises a bed 12 having a bumper structure including front sidewall bumpers 14 which converge to the front terminating in a front bumpers 16. A rear wall bumper 18 is parallel to front bumper 16 and adjoins diverging rear sidewalls 20 which are contiguous with first and second intermediate wall bumpers 22 and 24 respectively, which adjoin to the rear of the front sidewalls 14. Thus, bumpers 14 through 24 together describe a peripheral continuous bumper encircling the edge of the table.

In addition to the peripheral bumpers, a pair of bumper islands 26 are positioned symmetrically on the table and each includes a continuous bumper including external bumpers 28 which define corridors 30 with their respective front sidewalls 14, and inner bumpers 32 which adjoin the front ends of the bumpers 28 and swing around interiorly of the table top, segments 34 of which together define a straight longitudinal short channel 36 which separates a generally pentagonal front playing area 38 from a somewhat diamond-shaped rear playing area 40. These islands also define hairpin-shapes which articulate ball-receiving bays 42 in the frontal portions of the islands, with extended open legs 44 which, although somewhat too small to permit the free passage therethrough of a ball, can serve to place additional balls that fail to fit within the confines of the bay 42, should such balls require isolation in play, as they would when playing on the table according to certain rules provided therefore.

Figure 2:
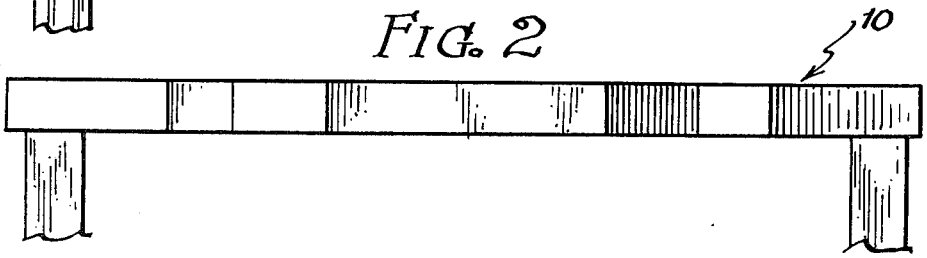
FIG. 2 is a section taken along line 2—2 of FIG. 1.

In addition to the front and rear playing areas, there are wing areas 46 defined by the first and second intermediate wall bumpers 22 and 24. In these areas are the holes 48 through which the balls drop into the rectangular pockets 50 shown in FIG. 2. Adjacent the holes 48 on each side are first and second bumper ends 52 and 54, respectively defined by the trailing ends of the islands.

The particular combination of bumpers, both peripheral and the central island bumpers, set forth and the relations between them are indicated by the designation of the subscribed angles included in FIG. 1. This particular arrangement enables the following types of play to be executed extremely satisfactorily. Turning first to the groups of arrows 56 indicated in the right wing area 46, indicates the number of possibilities of ball travel which will result in the ball sinking through the appropriate pocket 50. It will be noted that a sharp, accurate player may sink a ball off of either of the walls 14 or 24 when coming downward through corridor 30. It can also be seen that a properly hit ball can be made to bank off of the second intermediate wall 24, paralleling the first intermediate beneath the end 54 of the island, and cross over directly beneath the other end 54 to the opposite wing playing area 46. This gives the player a great deal of flexibility and enables him an opportunity to sink a ball with a single shot from the corridor, or either of the corridors, 30, or in the alternative, to cross directly over into the other wing area if, according to the game that is being played, it is his obligation to use that particular hole.

The arrows indicated at 58 depict an extension of the capabilities available in the wing area 46 wherein a person having a ball in the forward playing area 38 may bank it off the front wall 16, and by virtue of the possibilities inherent in the positioning of the intermediate bank bumpers 22 and 24, sink the ball. In both this and the more direct shooting as indicated by arrows 56, the bottom ends 52 and 54 of the island-defining bumpers may also effectively be used as bumpers. Lastly, turning to the arrows indicated at 60, it can be seen that a number of paths are also available from the rear playing area 40 into the pocket areas by virtue of single or multiple banks, although perhaps being somewhat more difficult in execution than from the upper portions of the playing table because of the unavailability of the back banking capabilities of the intermediate bumpers 22 and 24.

The channel 36 provides a certain amount of interest to the game, first by virtue of the balls being broken by a straight shot through this channel, and also insofar as it provides some communication between the two, otherwise distinct, playing areas 38 and 40.

Altogether, the table provides an environment suitable to a number of different games and incorporates as enhancements to the typical game of pool of billiards, a much wider variety of interesting banks and shots while at the same time scrupuously avoiding the provision of combinations often encountered by the players which would result in anger and frustration rather than the satisfaction of a shot well placed.

What is claimed is:

1. A generally arrow-head shaped billiard table comprising:

(a) a flat bed;

(b) a plurality of bumpers defined on said bed to define an enclosed space, said bumpers comprising the following:

(i) a pair of angulated front sidewall bumpers approaching one another toward the front and forwardly terminating in a transverse front wall bumper;

(ii) a pair of angulated rear sidewall bumpers approaching one another toward the rear and rearwardly terminating in a transverse rear wall bumper;

(iii) first and second intermediate wall bumpers extending respectively between the forward ends of each of said rear sidewall bumpers and the rear ends of said front sidewall bumpers to define laterally opposite wing areas;

(c) a pair of pocket holes defined in said bed in the respective wing areas spaced from said first and second intermediate wall bumpers; and, (d) a pair of islands having bumpers extending parallel to respective ones of said front sidewall bumpers to define a pair of elongated generally longitudinally directed corridors therewith.

2. Structure according to claim 1 wherein said islands include center bumper segments defining a longitudinal channel centrally of said pair.

3. Structure according to claim 2 wherein said front wall bumpers, rear wall bumper, and first intermediate wall bumpers are substantially parallel, and mutually perpendicular to said channel.

4. Structure according to claim 3 wherein said islands each have an interiorly directed bumper which together with said rear wall and said rear sidewall bumpers define an enlarged rear shooting area in the shape of a truncated diamond.

5. Structure according to claim 4 wherein each of said generally U-shaped islands has an outer bumper segment generally parallel to and spaced from their respective interiorly directed bumper and each island defines an expanded forward area comprising said bays.

6. Structure according to claim 2 wherein said islands are generally U-shaped and define elongated interior bays running generally parallel to said front sidewalls.

7. Structure according to claim 6 wherein said islands each have two ends, both of which are disposed in adjacent spaced relation to respective ones of said pocket holes to act as bumpers therefore.

8. Structure according to claim 7 wherein said first intermediate wall bumpers are substantially aligned and adequately spaced from the nearest of said island ends to act as a guide for a properly hit ball to direct same from one wing area to the opposite wing area.

* * * * *